US005389031A

United States Patent [19]

Sharpe, III et al.

[11] Patent Number: 5,389,031

[45] Date of Patent: Feb. 14, 1995

[54] TOY ASSEMBLY

[76] Inventors: Henry D. Sharpe, III, Box 202 471 Carpenter La., Saunderstown, R.I. 02874; Ralph A. Beckman, 257 President Ave., Providence, R.I. 02906

[21] Appl. No.: 132,911

[22] Filed: Oct. 5, 1993

[51] Int. Cl.[6] ..... A63H 5/00

[52] U.S. Cl. ..... 446/409; 446/432; 446/397

[58] Field of Search ..... 446/409, 410, 397, 130, 446/297, 303, 275, 270, 432; 273/243, 238; 434/185, 171, 318, 340

[56] References Cited

U.S. PATENT DOCUMENTS

| | | | |
|---|---|---|---|
| D. 297,034 | 8/1988 | Matsumoto | D21/133 |
| 1,640,417 | 8/1927 | Marks . | |
| 2,846,813 | 8/1958 | Giardina . | |
| 4,173,840 | 11/1979 | Fahrendorf et al. . | |
| 4,265,047 | 5/1981 | Meyer et al. | 446/397 X |
| 4,318,245 | 3/1982 | Stowell et al. . | |
| 4,325,199 | 4/1982 | McEdwards . | |
| 4,348,191 | 9/1982 | Lipsitz et al. | 446/297 X |
| 4,573,941 | 3/1986 | Holden et al. | 446/451 |
| 4,820,233 | 4/1989 | Weiner | 446/303 |
| 4,964,837 | 10/1990 | Collier | 446/409 |
| 4,993,983 | 2/1991 | Kurita et al. | 446/94 |
| 5,024,626 | 6/1991 | Robbins et al. | 446/409 |
| 5,147,237 | 9/1992 | Kwan et al. | 446/297 |
| 5,292,275 | 3/1994 | Swisher et al. | 446/409 |

*Primary Examiner*—Mickey Yu
*Attorney, Agent, or Firm*—Kurt R. Benson

[57] ABSTRACT

A toy assembly includes a base toy unit, a plurality of accessories which are removably receivable in predetermined positions on the base toy unit, a plurality of switch assemblies for detecting the absence or presence of the accessories relative to the respective predetermined positions thereof and a control unit which is responsive to the switch assemblies for issuing prerecorded sound effect, including voice messages. The sound effect are preferably related to the removal or repositioning of the accessories relative to the respective predetermined positions thereof on the base toy unit for leading, responding to and reinforcing the activity of a child in a play format. The base toy unit is preferably embodied as a toy vehicle, the accessories are preferably formed as accessories which are related to the vehicle and the sound effect are preferably related to the vehicle and the accessories.

27 Claims, 4 Drawing Sheets

TOY ASSEMBLY

BACKGROUND AND SUMMARY OF THE INVENTION

The instant invention relates to toys and more particularly to a toy assembly comprising a base unit, one or more accessories which are removably receivable on the base unit and a sound effect mechanism which is responsive to the removal of the accessories from, the absence of the accessories from, or the repositioning of the accessories in predetermined positions on the base unit for issuing predetermined voice messages and/or other sound effect.

A variety of different types of toys have been heretofore available which have been capable of issuing voice messages as well as other types of sound effect. In this regard, the U.S. Patent to Stowell et al, U.S. Pat. No. 4,318,245 relates to a toy doll comprising a synthesizer which is capable of producing speech sound effect in response to movement of the doll. Further, the U.S. Patent to Kwan et al, U.S. Pat. No. 5,147,237 discloses a toy action character figure which is manually actuatable for producing various sound effect. The U.S. Patent to Weiner, U.S. Pat. No. 4,820,233 also discloses a toy device which is capable of producing various sound effect, and the U.S. Patent to Collier, U.S. Pat. No. 4,964,837 discloses a radio controlled vehicle containing a sound effect system. However, the heretofore available devices of this general type have been incapable of effectively interacting with a child so as to lead, respond to and/or reinforce the activities of the child in a play format, and hence, their play value has generally been somewhat limited.

The instant invention provides an improved toy assembly which is capable of more effectively interacting with a child so as to lead, respond to and/or reinforce the activities of the child in a play pattern and which, therefore, has a substantially enhanced play value. Specifically, the instant invention provides an effective toy assembly which is capable of issuing sound effect, including voice message instructions, for leading, encouraging or responding to the activities of a child in a play pattern in response to the removal of one or more accessories from, the absence of the accessories from, or the repositioning of the accessories in predetermined positions on a base toy unit. More specifically, the toy assembly is capable of effectively issuing responses, prompts, commentary and instructions to add reality to a play pattern which involves the use of the one or more accessories in combination with the base toy unit. The toy assembly preferably includes sound effect means for issuing several different predetermined sound effect, including messages, in response to different activities relating to the accessories. Specifically, the sound effect means of the toy is preferably operative for issuing one of several possible and appropriate predetermined voice messages or sound effect in the event that a particular accessory is removed from the predetermined position thereof and for issuing one of several and appropriate predetermined messages in the event that the accessory is absent from the predetermined position thereof when another predetermined accessory is removed or replaced. The appropriateness of a particular message is preferably determined by examing the status of the other accessories. Still further, the sound effect means is preferably operative for issuing a voice message in response to repositioning the same accessory in the predetermined position thereof on the base toy unit. The base toy unit preferably comprises a toy vehicle, and the accessories preferably comprise accessories which are coordinated with the toy vehicle so that they are removably positionable in predetermined positions thereon. The toy vehicle is preferably embodied as a toy fire truck, and the accessories preferably comprise toy fire fighting accessories, such as a firefighter accessory, a dog mascot accessory, a fire hose accessory and a ladder accessory. The sound effect which are produced by the toy assembly are preferably coordinated with the fire truck for instructing a child to perform certain activities in connection therewith, for reinforcing certain actions, for guiding the child in the performance of further activities and for providing randomly timed sounds and voices that add to the reality of the play scenario, i.e. dog barking or radio communications. For example, when an accessory comprising a firefighter action character figure is removed from its predetermined position on the fire truck, the sound effect means in the fire truck is preferably operative for issuing a voice message to instruct a child to remove a hose accessory from a stored position on the truck and to assemble the hose accessory in an operative position thereon. As a second example, the sound effect means is preferably operative for issuing a message for directing the child to raise or pivot a ladder accessory attached to the fire truck once the ladder accessory has been moved from a predetermined stored position on the truck in order to lead or encourage the child in the operation of the ladder accessory. As a third example, when an accessory, such as a firefighter character figure or a dog mascot figure, is repositioned in its predetermined position on the fire truck, the sound effect means is preferably operative for issuing a voice message which praises the firefighter or the mascot for a job well done.

Accordingly, it is seen that the toy assembly of the instant invention represents a significant advancement in the art relating to toys of the general type which are capable of issuing voice messages. Specifically, the toy assembly is capable of issuing sound effect, including voice messages in response to the removal or absence of one or more accessories from, or the repositioning thereof on the base toy unit, and hence, it is capable of more effectively encouraging and reinforcing a child in an ongoing play pattern. Further, because the toy assembly is capable of responding to the absence or presence of the one or more accessories at the predetermined positions thereof on the base toy unit, it is capable of directing a child to remove the accessories from or to reposition them on the base toy unit during the course of a play pattern. Hence, it is seen that the toy assembly of the instant invention is capable of effectively interacting with a child to significantly increase the time period during which the toy assembly is capable of holding the child's attention. Consequently, it is readily seen that the toy assembly has a significantly increased play value as compared to the heretofore available toy assemblies.

Accordingly, it is a primary object of the instant invention to provide an effective toy assembly which is capable of interacting with a child through sound effect including voice messages.

Another object of the instant invention is to provide a toy assembly comprising a base unit, a plurality of accessories which are removably receivable on the base unit and a voice unit which is operative for issuing voice messages in response to the absence or presence of the accessories on the base unit.

Still another object of the instant invention is to provide an interactive toy assembly which is capable of issuing voice messages for supporting a child in a play format.

Another object of the invention is to provide a toy assembly which is capable of recognizing what accessories are attached to a base unit and what accessories are missing therefrom when the toy is turned on.

Other objects, features and advantages of the invention shall become apparent as the description thereof proceeds when considered in connection with the accompanying illustrative drawings.

DESCRIPTION OF THE DRAWINGS:

In the drawings which illustrate the best mode presently contemplated for carrying out the present invention.

DESCRIPTION OF THE INVENTION

Figure 1:
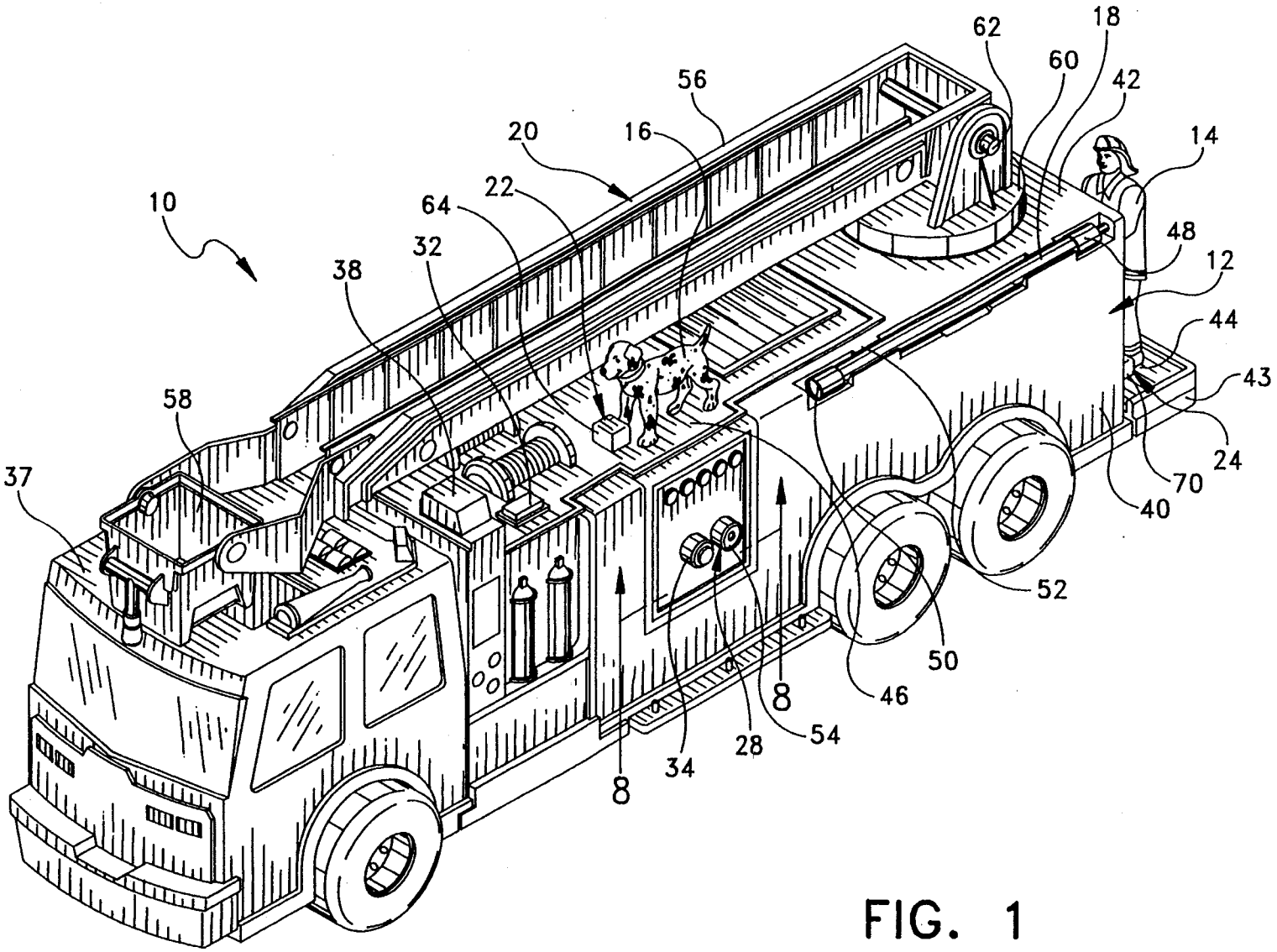
FIG. 1 is a perspective view of the toy assembly of the instant invention.
Figure 2:
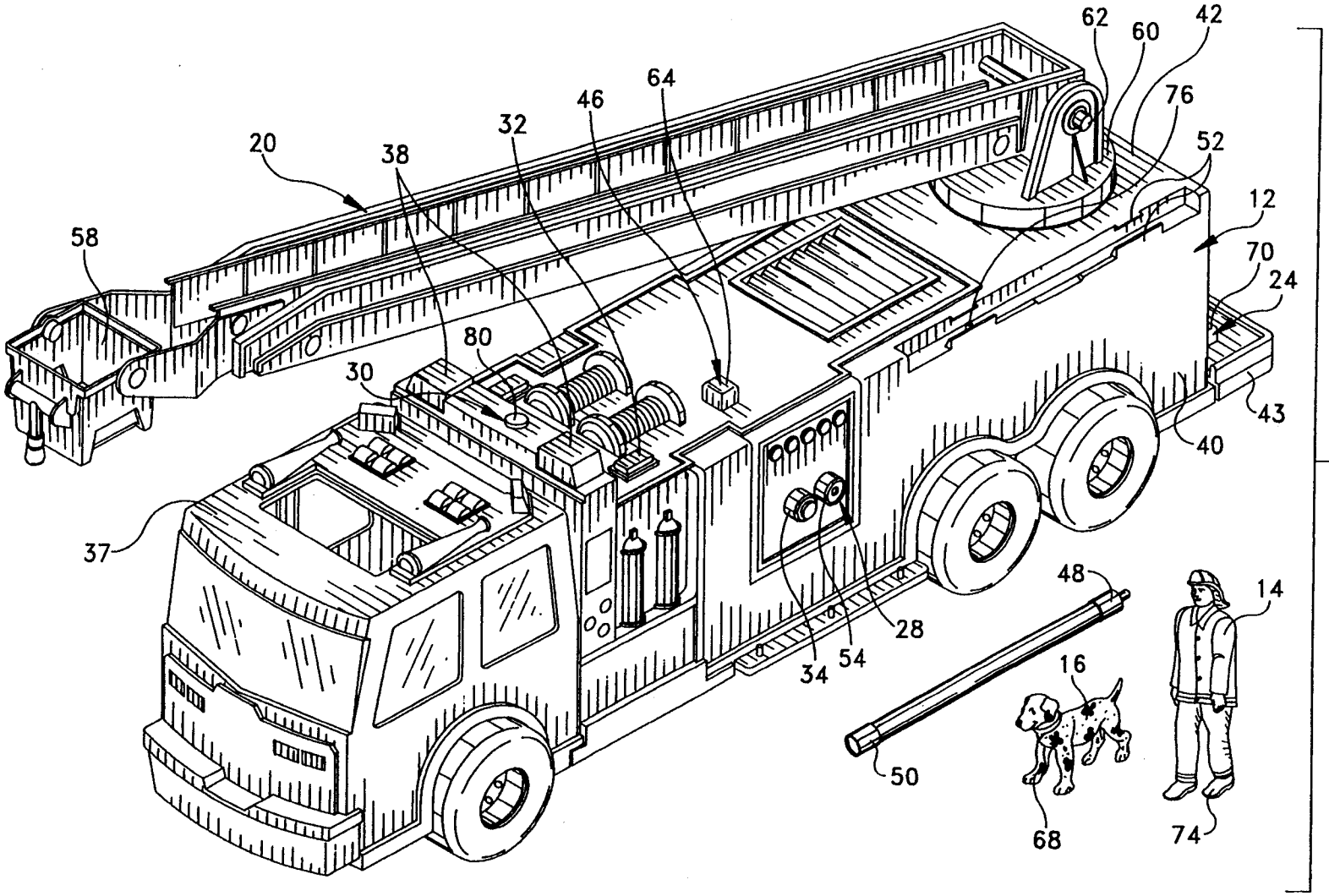
FIG. 2 is a perspective view thereof with several of the accessories removed.
Figure 3:
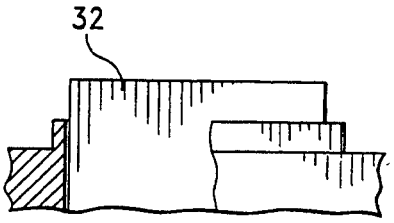
FIG. 3 is an enlarged fragmentary side sectional view of the start button.
Figure 4:
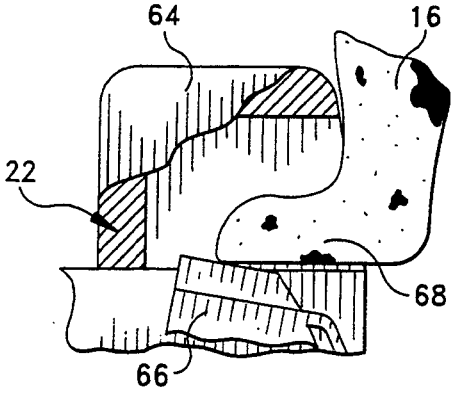
FIG. 4 is an enlarged fragmentary side sectional view of the dog accessory switch.
Figure 5:
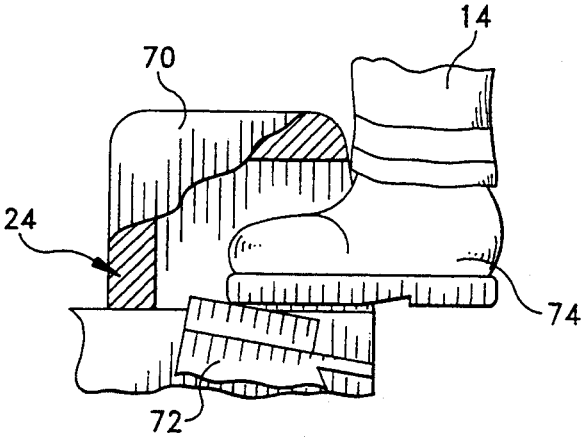
FIG. 5 is an enlarged fragmentary side sectional view of the fireman accessory switch.
Figure 6:
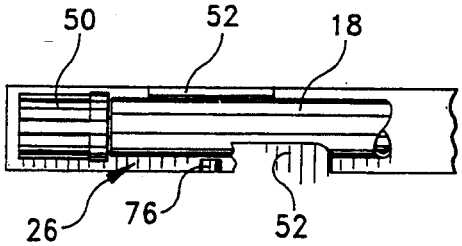
FIG. 6 is an enlarged fragmentary side elevational view of the fire hose accessory stored switch assembly.

Referring now to the drawings, the play assembly of the instant invention is illustrated in FIGS. 1 through 9 and generally indicated at 10 in FIGS. 1 and 2. The toy assembly 10 is herein embodied as a toy fire truck assembly, although it will be understood that it can alternatively be embodied in a variety of other vehicular and nonvehicular configurations. The toy assembly 10 comprises a fire truck or base unit generally indicated at 12 and a plurality of accessories including a fireman accessory 14, a mascot dog accessory 16, a fire hose accessory 18 and a ladder assembly accessory 20. The toy assembly 10 further comprises a plurality of switch assemblies on the base unit 12 for detecting the presence or absence of the accessories 14, 16, 18 and 20 in predetermined positions thereon. Specifically, the toy assembly 10 includes a dog accessory switch assembly generally indicated at 22, a fireman accessory switch assembly generally indicated at 24, first and second fire hose accessory switch assemblies generally indicated at 26 and 28, respectively, and a ladder accessory switch assembly generally indicated at 30. The toy assembly 10 further comprises a manually operated start switch 32, a manually operated water switch 34 and a master control 36. The switch assemblies 22, 24, 26, 28 and 30 and the manual switches 32 and 34 are electrically connected to the master control 36 which is responsive to the switch assemblies 22, 24, 26, 28 and 30 for detecting the presence or absence of the accessories 14, 16, 18 and 20 in predetermined positions on the base unit 12 and for issuing sound effect, including voice messages, which are related to the absence or presence, respectively, of the accessories 14, 16, 18 and 20 in the predetermined positions thereof. Accordingly, the play assembly 10 is operative for guiding and reinforcing the actions of a child so as to guide the child in a general play format involving the play assembly 10.

The base unit 12 comprises a conventional toy fire engine structure, and it functions as a housing for the master control 36. The base unit 12 includes a cab portion 37, a pair of lights 38, a rear portion 40 having an upper deck area 42 thereon and a rear platform 43. It will be understood, however, that the base unit 12 can alternatively be embodied in a variety of other vehicular or non-vehicular structures.

The accessories 14, 16, 18 and 20 are adapted to be received in predetermined locations on the base unit 12 as illustrated in FIG. 1. Specifically, the fireman accessory 14 is adapted to be received at a predetermined location 44 on the rear platform 43 in which it communicates with the switch assembly 24. Similarly, the dog mascot accessory 16 is adapted to be positioned at a predetermined location 46 on the upper deck area 42 in which the accessory 16 communicates with the dog switch assembly 22. The fire hose accessory 18 includes opposite male and female ends 48 and 50, and it is adapted to be alternatively positioned in either a stored position or an operative position on the base unit 12. Specifically, the fire hose 18 is adapted to be positioned in the stored position illustrated in FIG. 1 in which it is retained in a storage recess in the rear portion 40 by a plurality of integrally formed retaining lips 52. When the fire hose 18 is in this position, it communicates with the switch assembly 26 (see FIG. 6). Alternatively, the fire hose 18 is removable from the stored position thereof illustrated in FIG. 1, and the male end 48 of the fire hose 18 is receivable in a socket or hose connector 54 which comprises part of the second hose switch assembly 28. The ladder assembly 20 is of generally conventional construction, and it comprises a ladder unit 56 having a bucket 58 thereon for receiving and supporting a fireman. The ladder unit 56 is pivotally mounted on a turret 60 with a pivot shaft 62, and the turret 60 is rotatably mounted on the upper deck 42 as illustrated. The ladder 20 is alternatively positionable in the stored position thereof illustrated in FIG. 1 and various rotated positions, such as the one illustrated in FIG. 2. When the ladder 20 is in the stored position thereof, it communicates with the ladder switch assembly 30 in the manner illustrated in FIG. 7.

Figure 7:
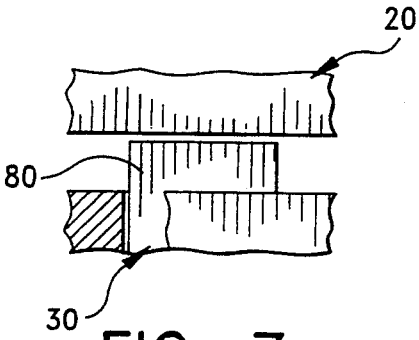
FIG. 7 is an enlarged fragmentary side sectional view of the ladder switch.
Figure 8:
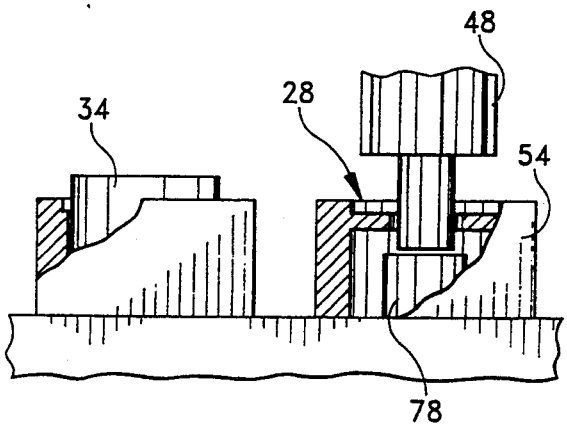
FIG. 8 is an enlarged fragmentary bottom sectional view of the water switch and the second fire hose accessory switch assembly taken along line 8—8 in FIG. 1.
Figure 9:
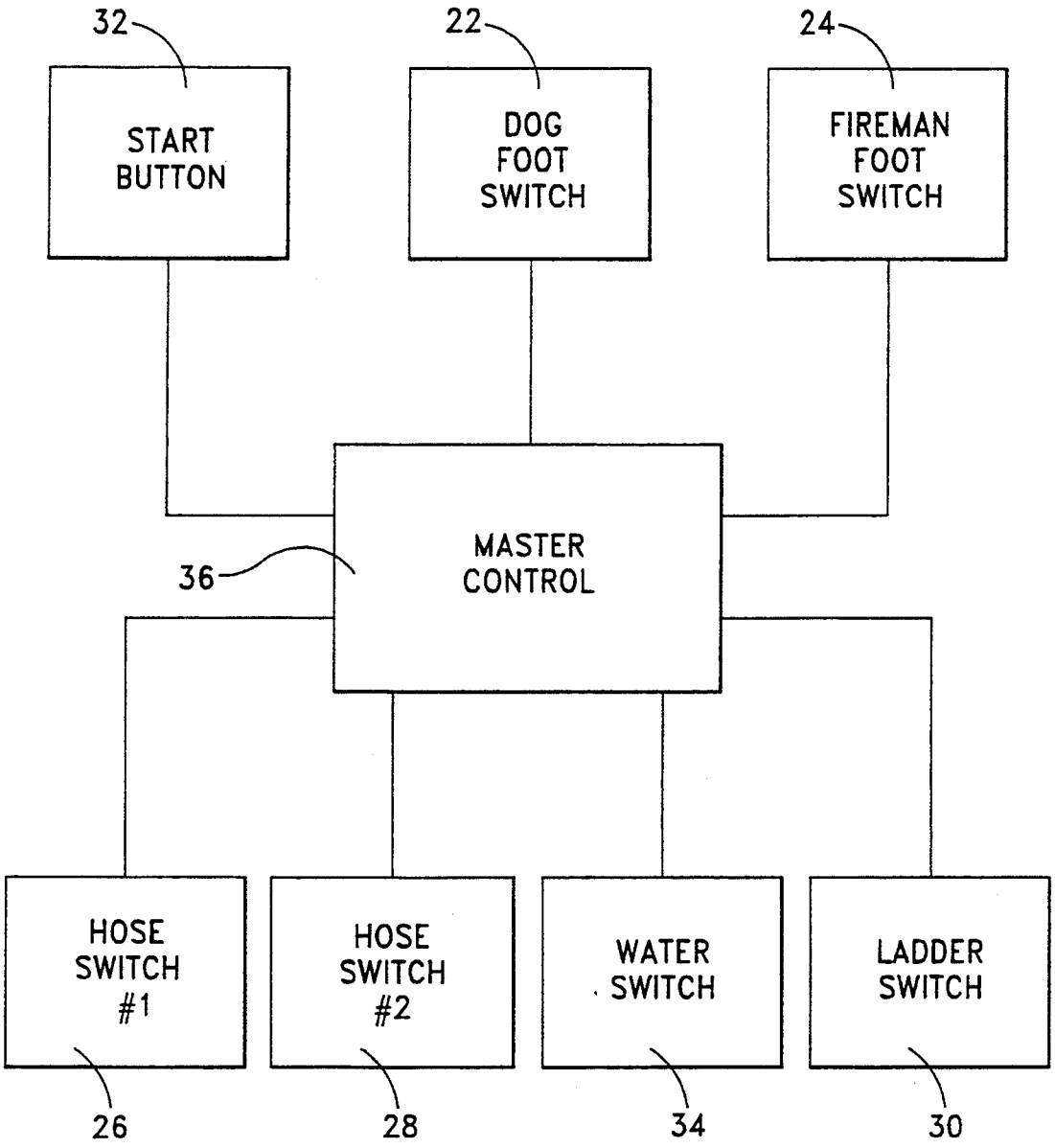
FIG. 9 is a schematic diagram of the master control and switches.

The switch assemblies 22, 24, 26, 28 and 30 are adapted to be engaged by their respective accessories in order to indicate the absence or presence of the accessories in the predetermined positions thereof. More specifically, the switch assembly 22 comprises a small open ended housing 64 containing a switch element 66 which is engagable by a foot 68 of the dog accessory 16 for indicating the presence or absence of the dog 16 in the predetermined position thereof. Similarly, the switch assembly 24 comprises a small open ended housing 70 containing a switch element 72 which is adapted to be engaged by a foot 74 of the fireman accessory 14. The first hose switch assembly 26 includes a switch element 76 which is adapted to be engaged by the hose 18 when the hose 18 is assembled in the stored position thereof on the rear portion 40. The second hose switch assembly 28, on the other hand, comprises the socket or female fitting 54 which is adapted for receiving the male end 48 of the hose 18. The second hose switch assembly 28 further includes a switch element 78 which is disposed within the fitting 54 so that it is engageable by the male end 48 to indicate that the hose 18 has been connected to the fitting 54. The hose 18 is further adapted so that the male end 48 thereof is frictionally securable to the fitting 54 to retain the terminal end portion of the male end 48 in engagement with the switch element 78. The ladder accessory 20 is adapted to engage the ladder switch assembly 30 for indicating the presence of the ladder 20 in the stored position thereof illustrated in FIG. 1. As illustrated in FIG. 7, the switch assembly 30 includes a switch element 80 which is directly engagable by the ladder 20 for indicating that the ladder is located in the stored position thereof.

The switch 32 comprises a start switch which is operative for actuating the operative components of the toy assembly 10, including the master controller 36, in a conventional manner.

The water switch 34 comprises a momentary switch which is operative by a user of the assembly 10 for actuating the master controller to produce certain sound effect, such as the sound of water flowing from a hose.

The master controller 36 is electrically connected to the dog and the fireman accessory foot switches 22 and 24, respectively, the first and second hose accessory switches 26 and 28, respectively the ladder accessory switch 30, the start button 32 and the water switch 34. The master controller comprises a battery power supply, a conventional controller, including a microprocessor which is programmed by conventional programming techniques for performing the functions set forth herein, and a digital sound effect unit which is operative for reproducing prerecorded voice messages, including sound effect, in a conventional manner. The master controller 36 is actuated by the start button 32 for illuminating the lights 38 and for producing certain sound effect, such as various voice messages, including randomly selected messages relating to various fire emergencies. The master controller 36 is further operative for detecting the positions of the dog accessory switch 22, the fireman accessory switch 24, the first hose accessory switch 26, the second hose accessory switch 28 and the ladder accessory switch 30 for detecting whether or not the accessories 14, 16, 18 and 20 are in the respective predetermined positions thereof on the base unit 12. The master controller 36 is further programmed so that it is responsive to the absence or presence of the various accessories at the predetermined positions thereof for issuing sound effect, including voice messages, which guide a child in a play format using the toy assembly 10. In this regard, the master controller 36 is responsive to the absence or presence of the various accessories for issuing various related voice messages and other sound effect when certain accessories are removed from or repositioned in the predetermined positions thereof. For example, when the fireman accessory 14 is removed from the predetermined position 44 thereof so that it no longer communicates with the fireman accessory switch 24 while the hose accessory is still in the stored position thereof, the master controller 36 is preferably operative for issuing a voice message to instruct a child to remove the hose accessory 18 from the stored position thereof and to assemble the hose accessory 18 in the operative position thereof wherein the male fitting 48 is received in the coupling 54. The master controller is preferably further programmed so that once that the male fitting 50 is received in engagement in the coupling 54, it issues a voice message which instructs the child to press the water switch 34; and once the switch 34 has been pressed, the master controller 36 is preferably operative for issuing related sound effect, such as sound effect relating to the flow of water from a hose. The master controller 36 is preferably further responsive to the dog accessory switch 22 for producing dog barking sounds when the dog accessory 16 is removed from the predetermined position 46 thereof, and the master controller 36 is preferably operative for issuing instructions pertaining to the ladder assembly 20 when the ladder assembly 20 is removed from the predetermined position thereof so that it is no longer received in engagement with the ladder switch 30. Even still further, the master controller 36 is preferably programmed so that when one of the accessories 14, 16, 18 or 20 is repositioned in the predetermined or stored position thereof on the base unit 12, the master controller 36 issues a voice message which prompts the child to reassemble the remaining accessories in their respective predetermined positions so that the toy assembly 10 can return home after a simulated fire fighting activity has been completed. In this regard, the accessories are counted as they are replaced on the base unit 12 during a play activity to enable the controller 36 to determine when only one accessory is missing. At that time the controller 36 issues a voice prompt reminding the child to include the final item, i.e. the fireman whistles for the dog, "let's go home!" Further, the master controller 36 is preferably programmed so that it takes inventory of the accessories 14, 16, 18 and 20 when the start switch 32 is initially depressed and so that it only issues instructions which relate to the accessories which are actually present at the beginning of a play activity. Hence, if one of the accessories has been inadvertently lost or misplaced, that accessory is excluded from the play pattern so that a more realistic play format can be followed during use of the assembly 10. Even still further, the master controller is preferably also programmed to issue various sound effect at predetermined time intervals to provide the ambience of a real environment for the toy assembly.

It is seen therefore that the instant invention provides an effective play assembly which has a high level of play value. In this regard, the apparatus 10 includes a plurality of separate accessories which are removable from predetermined positions on the base unit 12 during the course of a play activity. Further, the master controller 36 is operative for detecting the presence or absence of the accessories 14, 16, 18 and 20 relative to the predetermined or stored positions thereof on the base unit 12 and for directing a child in accordingly a play format. Hence, the assembly 10 provides an effective interactive apparatus which provides significantly increased interest for a child by instructing, encouraging and reinforcing the child in the operation of the fireman accessory 14, the dog accessory 16, the hose accessory 18 and the ladder accessory 20 and by praising the performance of the fireman accessory 14 and the dog accessory 16. Accordingly, the toy assembly 10 has an increased ability to capture and hold the attention of a child for a prolonged period of time during a play activity. In light of the above it is clear that the toy assembly 10 represents a new concept in interactive toys by guiding, reinforcing and encouraging a child in the operation of the apparatus 10 during a play activity.

Hence, it is seen that the apparatus 10 represents a significant improvement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy assembly comprising:

a base toy unit;

a first accessory removably receivable in a predetermined position on said base toy unit;

detecting means for detecting the absence or presence of said first accessory at the predetermined position thereof on said base my unit; and sound effect producing means on said base toy unit responsive to said detective means for producing a first prerecorded sound effect when said first accessory is removed from the predetermined position thereof on said base toy unit, said sound effect producing means being manually actuatable for producing a second prerecorded sound effect in the event that said first accessory is absent from the predetermined position thereof at a predetermined time during the operation of said sound effect producing means, said prerecorded sound effects including at least one voice communication.

2. In the toy assembly of claim 1, said first prerecorded sound effect comprising a first prerecorded voice message.

3. The toy assembly of claim 1 further comprising a second accessory removably receivable in a predetermined position on said base toy unit, said sound effect producing means being manually actuatable for producing said second sound effect by positioning said second accessory in the respective predetermined position thereof on said base toy unit.

4. In the toy assembly of claim 1, said sound effect producing means being operative for producing a third prerecorded sound effect when said first accessory is repositioned in the respective predetermined position thereof after said sound effect producing means has produced said second prerecorded sound effect.

5. The toy assembly of claim 1 further comprising a second accessory removably received in a predetermined position on said base toy unit, said sound effect producing means being manually actuatable producing said second prerecorded sound effect by removing said second accessory from the respective predetermined position thereof on said base toy unit.

6. In the toy assembly of claim 1, said base toy unit comprising a toy vehicle, said first accessory comprising an accessory which is coordinated with said toy vehicle.

7. In the toy assembly of claim 1, said first accessory being pivotally attached to said base toy unit and being pivotable to and from said predetermined position thereon.

8. A toy vehicle assembly comprising:

a toy emergency vehicle base unit;

an emergency vehicle accessory functionally coordinated with said base unit and removably received thereon in a predetermined position;

detecting means for detecting the removal of said accessory from said emergency vehicle base unit; and sound effect producing means responsive to the removal of said accessory from said emergency vehicle base unit as detected by said detecting means for producing a prerecorded voice message, including a spoken word phrase which is related to the removal of said accessory from said emergency vehicle base my unit.

9. In the toy vehicle of claim 8, said my emergency vehicle base toy unit comprising a toy fire engine, said accessory comprising a fire engine accessory.

10. A toy assembly comprising:

a base toy unit comprising a toy fire engine;

a first accessory comprising a toy ladder assembly pivotally attached to said toy fire engine and removably receivable in a predetermined position thereon;

detecting means for detecting the absence or presence of said first accessory at the predetermined position thereof on said toy fire engine; and sound effect producing means on said toy fire engine responsive to said detecting means for producing a first prerecorded sound effect when said first accessory is removed from the predetermined position thereof on said toy fire engine.

11. In the toy assembly of claim 10, said accessory comprising a firefighter character figure.

12. A toy assembly comprising:

a base toy unit comprising a toy fire engine;

a plurality of toy fire engine related accessories removably receivable in respective predetermined positions thereof on said base toy unit;

detecting means for detecting the absence or presence of said accessories in the respective predetermined positions thereof on said base my unit; and voice producing means on said base toy unit for detecting the absence or presence of said accessories relative to the respective predetermined positions thereof and for producing a predetermined voice message in response to the removal or repositioning of one of said accessories relative to the respective predetermined position thereon on said base toy unit.

13. In the toy assembly of claim 12, said voice message being dependent on the absence or presence of another one of said accessories relative to the respective predetermined position thereof.

14. In the toy assembly of claim 13, said voice producing means producing a first message in the event that said another one of said accessories is absent from the respective predetermined position thereof and producing a different second prerecorded voice message in the event that said another one of said accessories is present at the respective predetermined position thereof.

15. A toy assembly comprising:

a base toy unit;

a first accessory removably receivable in a predetermined position on said base toy unit;

detecting means for detecting the absence or presence of said first accessory at the predetermined position thereof on said base toy unit; and sound effect producing means on said base toy unit responsive to said detecting means for producing a first prerecorded voice message when said first accessory is removed from the predetermined position thereof on said base toy unit, said sound effect producing means being manually actuatable for producing a second predetermined voice message in the event that said first accessory is absent from the predetermined position thereof.

16. The toy assembly of claim 15 further comprising a second accessory removably receivable in a predetermined position on said base toy unit, said sound effect producing means being manually actuatable for issuing said second sound effect by positioning said second accessory in the respective predetermined position thereof on said base toy unit.

17. In the toy assembly of claim 15, said sound effect producing means being operative for issuing a third predetermined voice message when said first accessory is repositioned in the respective predetermined position thereof after the production of said second predetermined voice message.

18. The toy assembly of claim 15 further comprising a second accessory removably received in a predetermined position on said base toy unit, said sound effect producing means being manually actuatable for issuing said second predetermined voice message by removing said second accessory from the respective predetermined position thereof on said base toy unit.

19. In the toy assembly of claim 15, said first accessory being alternatively positionable in different first and second predetermined positions on said base toy unit, said sound effect producing means being responsive to positioning said first accessory in the second predetermined position thereof on said base toy unit for producing a second predetermined voice message.

20. A toy assembly comprising:

a base toy unit comprising a toy fire engine;

a fire engine related accessory removably receivable in a predetermined position on said base toy unit;

detecting means for detecting the absence or presence of said first accessory at the predetermined position thereof on said base toy unit; and sound effect producing means on said base toy unit responsive to said detecting means for issuing a prerecorded voice communication when said accessory is moved into the predetermined position thereof on said base toy unit.

21. A toy vehicle assembly comprising:

a toy fire engine base unit;

a toy fire engine accessory movably mounted on said base unit;

detecting means for detecting a predetermined movement of said accessory on said base unit; and sound effect producing means responsive to said predetermined movement as detected by said detecting means for producing a prerecorded voice message, including a spoken word phrase which is related to the movement of said accessory on said base unit.

22. In the toy vehicle of claim 21, said accessory comprising a ladder assembly on said toy fire engine.

23. In the toy vehicle of claim 22, said ladder assembly being pivotally mounted on said toy fire engine, said detecting means being responsive to predetermined pivotal movement of said ladder assembly for producting said voice message.

24. A toy assembly comprising:

a base toy unit;

a first accessory removably receivable in different first and second predetermined positions on said base toy unit;

detecting means for detecting the absence or presence of said first accessory at the predetermined first and second positions thereof on said base toy unit; and sound effect producing means on said base my unit responsive to said detecting means for producing a first prerecorded sound effect when said first accessory is removed from the first predetermined position thereof on said base toy unit and responsive to positioning said first accessory in the second predetermined position thereof on said base toy unit for producing a different second prerecorded sound effect.

25. In the toy assembly of claim 24, said base toy unit comprising a toy fire engine, said accessory comprising a toy fire hose which is positionable on said toy fire engine in stored and operative positions corresponding to said first and second positions, respectively.

26. A toy assembly comprising:

a base toy unit comprising a toy fire engine;

a first toy fire engine related accessory removably receivable in a predetermined position on said base toy unit;

detecting means for detecting the absence or presence of said first accessory at the predetermined position thereof on said toy fire engine; and sound effect producing means on said toy ire event responsive to said detecting means for producing a first prerecorded voice communication when said first accessory is removed from the predetermined position thereof on said toy fire engine.

27. A toy assembly comprising:

a base toy unit; a first accessory removably receivable in a predetermined position on said base toy unit;

detecting means for detecting the absence or presence of said first accessory at the predetermined position thereof on said base toy unit; and sound effect producing means on said base toy unit responsive to said detecting means for producing a first prerecorded sound effect when said first accessory is removed from the predetermined position thereof on said base toy unit, said first prerecorded sound effect comprising a first prerecorded voice message which is randomly selected from a group of a plurality of prerecorded voice messages, each of the voice messages in said group being related in context to the removal of said first accessory from the predetermined position thereof.

* * * * *